United States Patent [19]

Daniel

[11] 4,178,791

[45] Dec. 18, 1979

[54] METHOD AND APPARATUS FOR CORRECTING BENT AXLE MISALIGNMENT

[76] Inventor: Danny O. Daniel, Rte. 3, Box 57A, Blackfoot, Id. 83221

[21] Appl. No.: 772,294

[22] Filed: Feb. 25, 1977

[51] Int. Cl.[2] ..... B21D 1/12

[52] U.S. Cl. ..... 72/388; 72/704

[58] Field of Search ..... 72/386, 388, 704, 705, 72/457–459

[56] References Cited

U.S. PATENT DOCUMENTS

| | | | |
|---|---|---|---|
| 1,869,905 | 8/1932 | Marsh et al. | 72/704 |
| 2,134,501 | 10/1938 | Bennett | 72/705 |
| 2,142,850 | 1/1939 | Johnston | 72/705 |
| 2,256,231 | 9/1941 | Bender | 72/705 |
| 2,427,536 | 9/1947 | Simons | 72/704 |
| 2,431,291 | 11/1947 | Wochner | 72/704 |
| 2,764,215 | 9/1956 | Adams et al. | 72/704 |
| 3,765,219 | 10/1973 | Easom | 72/704 |
| 3,777,542 | 12/1973 | Foshee | 72/704 |

*Primary Examiner*—Leon Gilden
*Assistant Examiner*—D. M. Gurley
*Attorney, Agent, or Firm*—Snider, Sterne & Saidman

[57] ABSTRACT

A technique and device for correcting front end misalignment resulting from bent or twisted front axle assemblies which may be performed without dismantling the front end of the vehicle. The apparatus includes means for laterally clamping the axle assembly and means for applying a bending force to the axle at a position laterally displaced from that of the clamping means. A base assembly is utilized to support the axle at its normal height after the wheel has been removed. A novel breast plate is utilized to support the base of a horizontally disposed hydraulic jack which provides the desired camber correction. Preferred embodiments are particularly designed to be utilized with Volkswagen automobiles.

25 Claims, 7 Drawing Figures

FIG. 1.
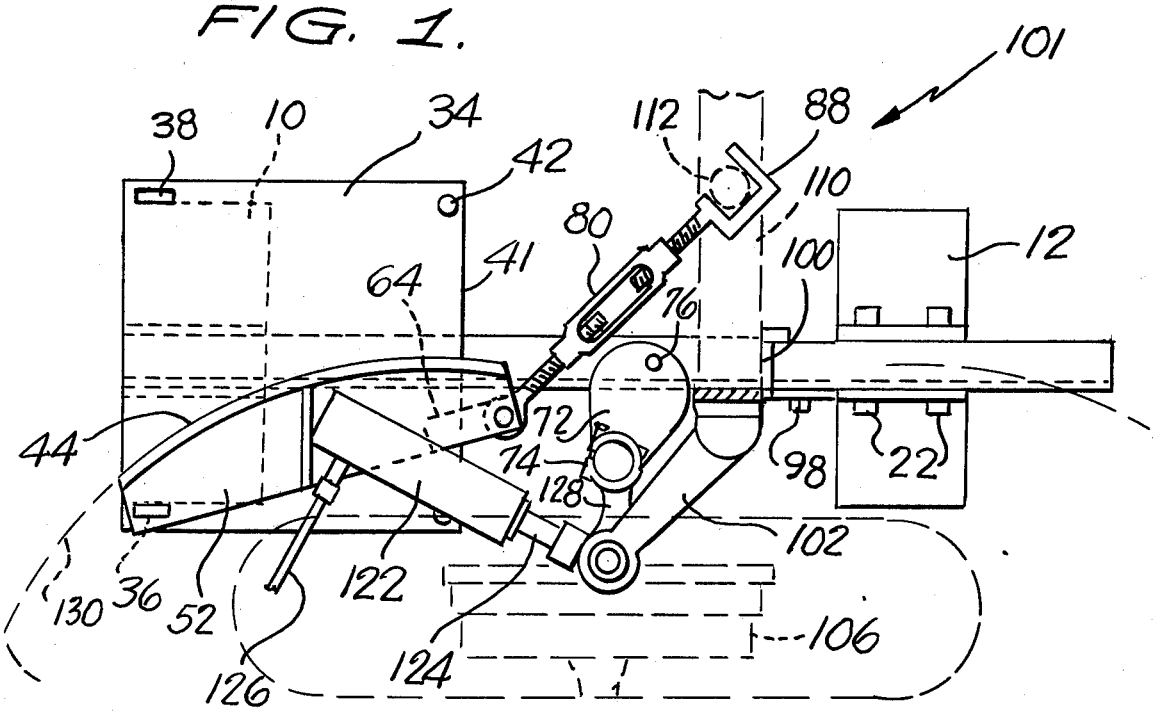
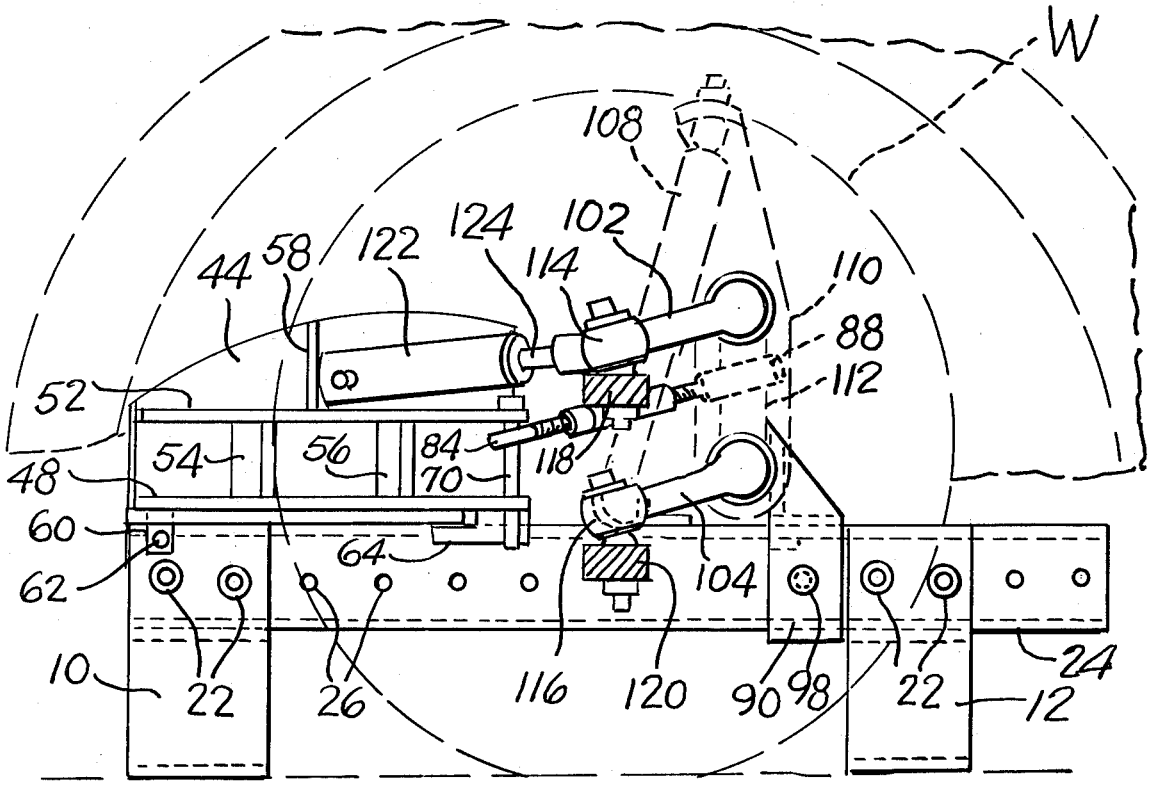
FIG. 2.

METHOD AND APPARATUS FOR CORRECTING BENT AXLE MISALIGNMENT

BACKGROUND OF THE INVENTION

1. Field of the Invention

The present invention is related to automative repair equipment and techniques and, more particularly, is directed towards a novel method and apparatus for correcting front end alignment which results from bent front axle assemblies.

2. Description of the Prior Art

The importance of maintaining proper front end alignment in motor vehicles is well recognized. The multitude of parts which make up the wheel support sections of a motor vehicle each provide a potential source of misalignment. While conventional alignment equipment available to most mechanics is able to correct many such sources of misalignment, many situations nevertheless arise for which conventional equipment simply will not do the job.

Misalignment caused by deformed or bent struts is an example of a condition for which conventional alignment equipment is unsatisfactory. Described in my prior U.S. Patent Application Ser. No. 715,375, filed Aug. 18, 1976, and now U.S. Pat. No. 4,103,531 is a method and apparatus for correcting bent strut misalignment which provides an economic and effective solution to the problem of conveniently and accurately correcting misalignment resulting from bent or otherwise deformed struts.

I have recognized that a similar problem exists with respect to misalignment caused by bent front axle assemblies, such as those found in Volkswagen automobiles. These front axle assemblies are characterized by a twin I beam horizontally disposed front axle which has a pair of upper and lower torsion arms extending rearwardly from both ends thereof. The spindle, hub and drum of the vehicle are connected via the upper and lower ball joints to the upper and lower torsion arms, respectively.

In earlier model Volkswagens, for example, which include model years 1948 through 1969, the twin axle beam is connected at its approximate mid-section to the head of the frame of the automobile, commonly referred to as the header. I have found that the twin beams tend to be deformed between the connection point to the header and the torsion arms if the vehicle is in an accident, runs over a curb, or the like. For later model Volkswagens (beginning with model year 1970), the twin I beam is mounted to the frame by twin, spaced headers which are arranged in a Y-configuration with respect to the front axle, rather than being centrally located as is the case with the earlier models. I have found, with the later models, that the torsion arms themselves, which extend laterally and rearwardly from both ends of the twin front axle, are apt to be bent if the automobile jumps a curb, is involved in an accident, runs over a pothole, or the like.

Prior art techniques of correcting misalignment resulting from either bent front axle beams or bent torsion bars required the front end of the automobile to be totally dismantled in order to remove the damaged part, and either bent it back into shape, or replace it.

It therefore may be appreciated that a technique which would enable the bent or deformed axle and/or torsion arms to be straightened while remaining installed on the automobile would provide a great advance over presently available techniques in terms of both labor and part economy. It is towards this end that the present invention is advanced.

OBJECTS AND SUMMARY OF THE INVENTION it is therefore a primary object of the present invention to provide a method and apparatus for correcting misalignment of the front end of an automobile resulting from a bent axle assembly which overcomes all of the deficiencies noted above with respect to prior art techniques and devices.

Another object of the present invention is to provide a new and improved technique for correcting misalignment resulting from deformed front and axles which does not require the front end of the automobile to be dismantled, thereby permitting correct alignment to be achieved in far less time than previously possible.

An additional object of the present invention is to provide apparatus for permitting the front ends of Volkswagen automobiles to be easily, simply, cheaply and quickly aligned.

A still further object of the present invention is to provide a technique and device for permitting easy, accurate and rapid camber adjustment of the front end of certain automobiles when the misalignment is caused by a bent, deformed, or otherwise misaligned front axle assembly.

A more specific object of the present invention is to provide apparatus for correcting bent axle misalignment which is universally applicable to Volkswagen automobiles, and which effectuates straightening of their front twin I beam and/or upper and lower torsion arms without requiring the front end to be dismantled, and in a minimum amount of time.

The foregoing and other objects are attained in accordance with one aspect of the present invention through the provision of apparatus which comprises means for clamping an axle assembly of a vehicle, and means operatively coupled to the clamping means for bending the axle assembly while installed in the vehicle. The bending means more particularly comprises hydraulic jack means, and means for supporting the hydraulic jack means. The hydraulic jack supporting means preferably comprises a base member which is adapted to be positioned underneath the axle assembly, and a breast plate which is pivotally coupled to the base member. Means are further pivotally coupled to the base member which is adapted to support the lower end of the shock absorber of the vehicle.

In accordance with more specific aspects of the present invention, the base member comprises a substantially planar support plate that is positioned rearwardly of the axle assembly and which includes aperture means formed therein for pivotally receiving the breast plate. The breast plate provides a means for supporting the base of the hydraulic jack such that the latter is disposed substantially horizontally during use. The jack support means comprise a plurality of substantially vertically disposed plates which are arranged to support the base of the jack in a plurality of different bending positions. The outer, vertically oriented wall of the breast plate is curved in such a fashion so as to be congruent with the inner wheel housing against which the breast plate is positioned during use.

In accordance with yet more specific aspects of the present invention, for early model Volkswagens (1948–1969), the breast plate is provided in the form of left and right breast plate assemblies, which are substantial mirror images of one another, and which are adapted to be utilized respectively on the left and right front ends of Volkswagen automobiles (1948–1969). The rear end of each breast plate in use in pivotally attached to the rear of the support plate, while the front end of the breast plate is laterally movable.

In accordance with yet other more specific aspects of the present invention, the breast plate, for Volkswagens manufactured after 1970, may be comprised of a single, reversible breast plate assembly which may be adapted for use on both the left and right front ends of such Volkswagen automobiles. For the alternate breast plate assembly, the front end thereof is pivotally mounted to the forward end of the planar support plate, the rear end of the breast plate assembly being laterally movable along the rear portion of the support plate.

In accordance with other aspects of the present invention, the clamping means is adjustably connected between the axle assembly and the breast plate. More specifically, the clamping means comprises a turn buckle assembly having a rearwardly extending threaded member that is pivotally connected to the forward end of the breast plate, and a forwardly projecting threaded member having a clamp at its distal end which is secured to the axle assembly at a fulcrum position.

The base member further comprises an elogated rail assembly that is positioned transversely with respect to the axle assembly for supporting same at substantially the same height as would be the axle assembly if the wheel of the vehicle were in place. A further clamping means may be slidably positioned on the rail assembly forwardly of the axle assembly to prevent forward movement thereof. The bending means in the form of the hydraulic jack may be selectively placed on the breast plate for bending either the front axle beam, the upper torsion arm, or the lower torsion arm.

In accordance with still other aspects of the present invention, there is provided a technique for correcting misalignment of the front end of a vehicle which results from a bent front axle assembly. The technique, which may be performed without dismantling the front end of the vehicle, comprises the steps of clamping the axle assembly at a first position (which defines a fulcrum), and applying a bending force to the axle assembly at a second position that is laterally displaced from the first position. The clamping step more particularly includes the step of preventing forward and rearward movement of the axle assembly, while the force applying step includes the steps of positioning a supporting base underneath the front axle assembly, mounting a jack support member on the base rearwardly of the axle assembly, and operating jack means between the jack support member and the second position at which the bending force is applied. More specifically, the axle assembly comprises a horizontally disposed twin axle beam and a pair of upper and lower torsion arms which extend from each end of the twin axle beam. To prevent twisting, the lower end of the shock absorber of the vehicle is preferably supported on the base member. The jack means may be positioned, alternatively, so as to exert either substantially lateral, upward, or downward pressure on the axle assembly, as the particular correction may require.

BRIEF DESCRIPTION OF THE DRAWINGS

Various objects, features and attendant advantages of the present invention will be more fully appreciated as the same become better understood from the following detailed description thereof when considered in connection with the accompanying drawings, in which:

FIG. 1 is a top, plan view, partly in section, which illustrates a preferred embodiment of the present invention installed on the front end of a motor vehicle during use;

FIG. 2 is a side view of the apparatus illustrated in FIG. 1;

DETAILED DESCRIPTION OF THE PREFERRED EMBODIMENTS

Figure 3:
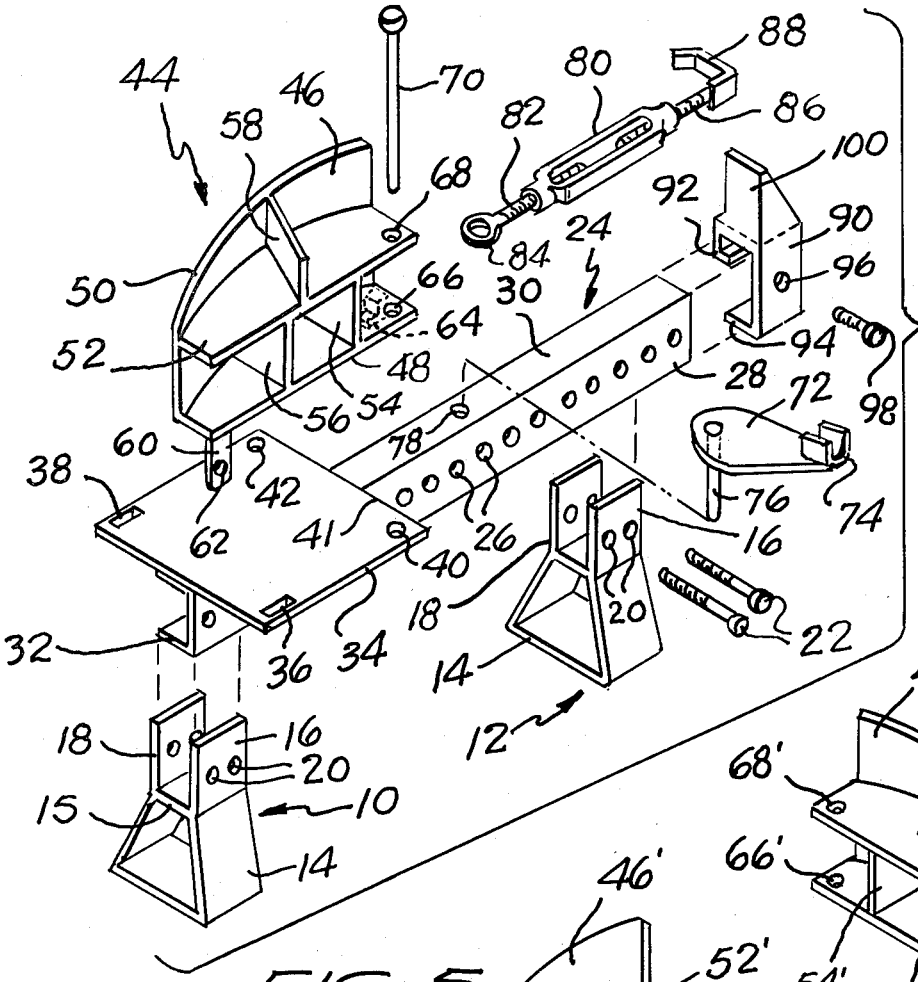
FIG. 3 is an exploded, perspective view which illustrates the basic components of a first preferred embodiment of the present invention utilized in FIGS. 1 and 2.

Referring now to the drawings, wherein like reference numerals designate identical or corresponding parts throughout the several views, and more particularly to FIG. 3 thereof, there is illustrated in an exploded, perspective view the main components of a preferred embodiment of the apparatus of the present invention, which may also be utilized in effectuating the technique of correcting misalignment resulting from a bent or otherwise deformed front axle assembly, as will be described in more detail hereinafter in connection with the specific examples illustrated in FIGS. 1 and 2.

The preferred embodiment of the present invention illustrated in FIG. 3 includes a rear support stand 10 and a front support stand 12, which may be substantially identical with one another. Each of the support stands 10 and 12 include a trapezoidal base support portion 14 having an upper horizontal support member 15. Extending upwardly from horizontal support member 15 are a pair of parallel flanges 16 and 18. Positioned in flanges 16 and 18 of each support stand 10 and 12 are a pair of apertures 20 which are aligned and sized so as to receive a pair of positioning and locking bolts 22.

Stands 10 and 12 are adapted to serve as support means for an elongated base rail, indicated generally by reference numeral 24, which is preferably in the form of a U-shaped channel member consisting of a vertical side plate 28, and parallel top and bottom flanges 30 and 32. Positioned longitudinally along the vertical side plate 28 are a plurality of spaced apertures 26 which are designed to receive locking bolts 22 so as to position stands 10 and 12 as desired.

Connected to the rear end of elongated base rail 24 is a base plate 34 which is securely mounted, as by welding, to the top flange 30 of rail 24. Base plate 34 is provided at its rear corners with a pair of mounting slots 36 and 38, and at its front corners with a pair of mounting apertures 40 and 42, for purposes which will become more clear hereinafter.

The preferred embodiment of the present invention also includes a breast plate which is indicated generally by reference numeral 44. Breast plate 44 as illustrated in FIG. 3 is particularly designed to be utilized in connection with correcting bent axle misalignment in connection with the right front end of early model (1948–1969) Volkswagen automobiles. Although the ensuing discussion will be presented in connection with such automobiles as a preferred example and best mode, it should be understood that the principles of the present invention may be easily extended to other makes, models and designs of motor vehicles.

Figure 4:
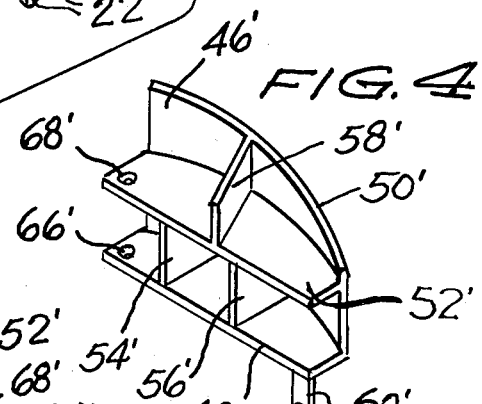
FIG. 4 is a perspective view illustrating an alternative component which may be utilized in connection with the preferred embodiment illustrated in FIG. 3.
Figure 5:
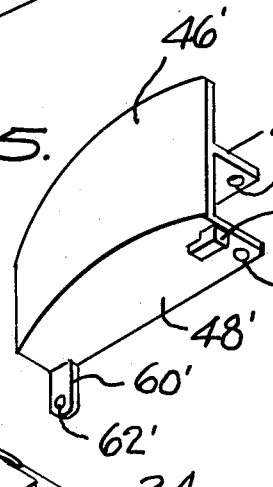
FIG. 5 is another perspective view of the same component illustrated in FIG. 4.

The right front breast plate 44 illustrated in FIG. 3 has a counterpart which is utilized in connection with the correction of bent axle misalignment in the left front ends of early model (1948–1969) Volkswagens, the left front breast plate being illustrated in more detail in FIGS. 4 and 5. The elements of the left front breast plate illustrated in FIGS. 4 and 5 which correspond to those of the right front breast plate 44 illustrated in FIG. 3 are indicated by like primed numerals. Since the left and right front breast plates may be substantially identical mirror images of one another, description of the construction of the right front plate 44 will serve as an adequate description of the left front plate illustrated in FIGS. 4 and 5.

Referring back to FIG. 3, the right front breast plate 44 includes a curved and substantially vertical side plate 46 which is designed in particular to mate with the inner wheel housing or frame assembly of the right front end of 1948 through 1969 Volkswagen automobiles. As mentioned hereinabove, such Volkswagens are characterized by a twin, front axle beam which connects at its approximate mid-point to the header of the frame assembly, a construction which dictated the particular shape of side plate 46.

Breast plate 44 further includes a substantially planar base 48 which extends from the lower edge of curved side plate 46 and which, in use, is supported directly on the base plate 34. Note that the top edge 50 of the curved side plate 46 is also tapered downwardly from front to rear to provide the desired fit with the inner frame of the automobile.

Breast plate 44 further comprises a supplementary support plate 52 which extends from the curved wall 46 and is positioned above and substantially parallel to the base 48. Connected in a substantially perpendicular fashion between plates 48 and 52 are a pair of jack support plates 54 and 56 which are laterally spaced from one another as indicated in the drawing. Extending upwardly from the support plate 52 is a third jack support plate 58 which is angled somewhat with respect to the orientation of jack support plates 54 and 56, for a purpose which will become more clear hereinafter.

From the underside of the rear portion of base 48 extends a mounting ear 60 which is designed to be fitted within aperture 36 in base plate 34. The lower portion of ear 60 includes a pin-receiving aperture 62 for journaling the breast plate 44 against upward movement. Extending also from the underside of base 48 but at the frontal portion thereof is an L-shaped retaining bracket 64 which is adapted to fit over the front edge 41 of base plate 34. Bracket 64 extends rearwardly a sufficient distance so as to permit substantial lateral movement of the front portion of breast plate 44 during use (see FIG. 1).

Positioned in the front-most corners of plates 48 and 52 are a pair of apertures 66 and 68 for receiving a pivot bolt 70.

The left front breast plate illustrated in FIGS. 4 and 5 likewise includes a downwardly depending mounting ear 60' which, during use, may be fitted within slot 38 of base plate 34, while L-shaped retaining bracket 64' fits over the front edge 41 of base plate 34, in a manner analagous to the installation of right front breast plate 44 described above.

The preferred embodiment of the present invention illustrated in FIG. 3 further includes a substantially planar pivot plate 72, of a tear drop shape, which is designed as a bottom support for the shock absorber of the front end of the vehicle during use. The pivot plate 72 includes a shock absorber support cup 74 formed on the free end thereof and a mounting pin 76 extending downwardly and adapted to be fitted within a central aperture 78 formed in the upper flange 30 of rail 24. The pivotable design of pivot plate 72 permits same to be utilized for both left and right front end operations to support the lower end of the shock absorber.

A clamping member is also provided and may preferably take the form of a turnbuckle 80 having one threaded arm 82 which terminates in a ring 84. Ring 84 is adapted to be mounted between plates 48 and 52 in such a fashion so as to receive bolt 70 when inserted through apertures 68 and 66. The other threaded arm 86 of turnbuckle 80 terminates in a clamp member 88 which is designed to grasp a portion of the front axle beam, as will be described in more detail below.

The preferred embodiment of the present invention also may include a front brace member 90 which is adapted to be slidingly received on the front portion of elongated rail 24 by means of upper and lower positioning flanges 92 and 94. The side wall of brace 90 preferably includes an aperture 96 which is adapted to receive a mounting bolt 98 in order to secure the position of brace 90 along rail 24. Brace 90 includes a face plate 100 which is adapted to clampingly secure the front axle assembly, as will be described below.

Referring now to FIGS. 1 and 2, the front axle assembly of an early model (1948–1969) Volkswagen automobile is indicated generally by reference numeral 101. The front axle assembly 101 includes a horizontally extending, front axle, twin beam 110 which has a vertical connecting post 112 positioned substantially as indicated. The front axle assembly 101 also may be said to include an upper torsion arm 102 and a lower torsion arm 104 which extend laterally and rearwardly of both ends of the front axle beam 110 (only the right end is illustrated in the drawing figures). Between the upper and lower torsion arms 102 and 104 is mounted a spindle assembly (not shown) to which is conventionally mounted the hub and drum 106 of the vehicle. Also conventionally provided is a shock absorber 108 which extends between the upper portion of vertical connecting post 112 and a horizontal shock support arm 128 (FIG. 1). Reference numeral 114 indicates the distal end of upper torsion arm 102 which serves as a holder for the upper ball joint 118, while reference numeral 116 indicates the holder for the lower ball joint 120, all of which is conventional.

Reference numeral 122 indicates a bending means preferably in the form of a conventional hydraulic jack having a piston 124 which extends from one end thereof. The feed line for hydraulic jack 122 is indicated by reference numeral 126, while reference numeral 130 in FIG. 1 designates the inner wheel housing of the automobile against which the breast plate 44 rests during use.

In describing the operational technique of the present invention in connection with FIGS. 1 and 2, let it be assumed that misalignment to the front end of the vehicle is being caused by a bent upper torsion arm 102. This may become apparent upon a visual inspection of the front end, in combination with an overly negative camber reading from conventional gauges. When this is determined, the automobile is jacked up and the wheel is removed. Stands 10 and 12 with rail 24 connected are then slid under the automobile to the desired position. The right front breast plate 44 is then installed in base plate 34 by inserting the mounting ear 60 through aperture 36 in plate 34. A pin may be inserted through hole 62 in aperture 60 to secure the breast plate 44 against upward movement. It is noted that the front L-shaped bracket 64 is positioned about and underneath the front edge 41 of base plate 34 so as to permit breast plate 44 some degree of lateral movement.

After the breast plate 44 has been installed, the front end of the automobile is lowered until the axle beam 110 rests upon the upper flangle 30 of rail 24. The height of flange 30 is designed such that, in the position indicated in FIG. 2, the front axle beam 110 is in substantially the same position as it would be if the wheel W were mounted.

Brace 90 may then be secured in place as by bolt 98 such that its face plate 100 bears against front axle beam 110 to prevent forward movement thereof.

Prior to lowering the automobile, the pivot plate 72 is positioned such that cup 74 receives the lower end of shock absorber 108, as indicated most clearly in FIG. 1. Plate 72 is instrumental in preventing undesired downward movement when the bending force is later applied.

After brace 90 is positioned as described above, turnbuckle 80 is installed by positioning bolt 70 through aperture 68, ring 84, and aperture 66, successively, and by positioning clamp 88 about the vertical connecting member 112 of front axle beam 110. The turnbuckle may then be tightened to take up any slack.

Having determined that the upper torsion arm 102 requires straightening, the hydraulic jack 122 is positioned adjacent jack support plate 58 such that the end of piston 124 bears against the socket portion 114 of upper torsion arm 102. When the jack 122 is actuated in the position illustrated, the effect will be to bend torsion arm 102 in such a fashion so as to restore positive camber to the wheel W.

If, on the other hand, it were desired to impart a more negative camber to the wheel W, the base of the hydraulic jack 122 may be placed against either jack support plate 54 or jack support plate 56, while the piston 124 may be positioned against the socket end 116 of the lower torsion arm 104. Still alternatively, the base of jack 122 could be positioned in plate 56 and piston 124 may be positioned to bear against socket 114 so as to impart an even greater bending force to the upper torsion arm 102, which would result in a more positive camber being imparted to the wheel W. Clearly, many variations in the placement of jack 122 are possible, the particular configuration of FIGS. 1 and 2 being shown and described only for the purposes of illustration.

Figure 6:
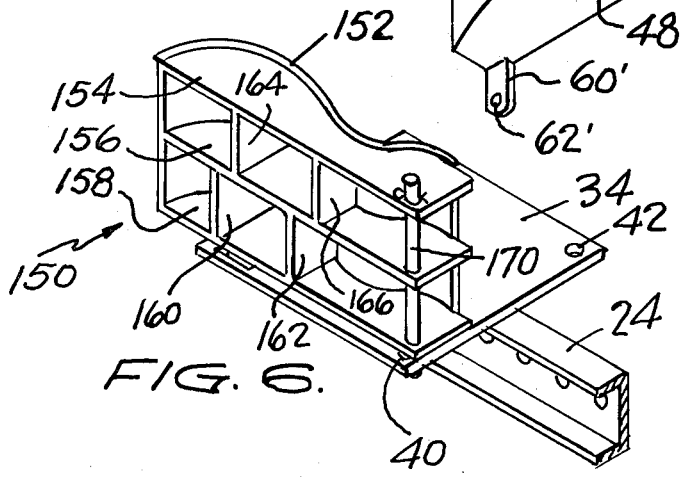
FIG. 6 is a perspective view of yet another and alternative embodiment of a component which may be utilized with the present invention.
Figure 7:
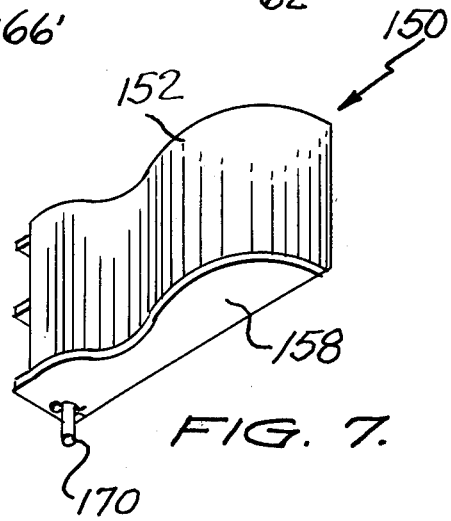
FIG. 7 is another and alternative perspective view which illustrates one of the alternate preferred embodiment components shown in FIG. 6.

Referring now to FIGS. 6 and 7, there is indicated by reference numeral 150 an alternative breast plate which is designed in particular for use for correcting bent axle misalignment in the front ends of Volkswagen automobiles manufactured since the model year 1970. The breast plate 150 is reversible in that it may be utilized either for the left or right front end of such automobiles. The redesign of breast plate 150 from the pair of breast plates required for the earlier model automobiles resulted from the change in design, as discussed above, of the mounting of the front axle beam to the header assembly of the frame. Since the outer vertical wall 152 of the breast plate 150 must bear against the inner wheel housing or frame of the automobile, the vertical plate 152 is curved, in a somewhat S-shaped configuration, so as to provide the necessary tight fit during use.

Breast plate 150 includes three substantially identical, parallel, and planar horizontal support plates 154, 156 and 158, between which are positioned a plurality of jack support plates 160, 162, 164 and 166. The horizontal support plates 154, 156 and 158 each include a mounting aperture in a front-most corner for receiving a pivot pin 170. Note that the reversible breast plate 150 for the later model Volkswagens is designed to be pivotable at a front portion and laterally movable at its rear, in contrast to the breast plates for the earlier models. The pivot pin 170 may be mounted either in front aperture 40 for the right front end, or the front aperture 42 for the left front end, of the late model automobiles.

Obviously, numerous modifications and variations of the present invention are possible in light of the above teachings. It is therefore to be understood that within the scope of the appended claims, the invention may be practiced otherwise than as specifically described herein.

I claim as my invention:

1. Apparatus, which comprises:

means for clamping an axle assembly of a vehicle having an inner wheel housing;

hydraulic jack means operatively coupled to said clamping means for bending said axle assembly while installed in said vehicle; and means for supporting said hydraulic jack means, said means for supporting comprising base means adapted to be positioned underneath said axle assembly, said means for supporting further comprising breast plate means pivotally coupled to said base means;

wherein said breast plate means includes means for supporting the base of said hydraulic jack means such that the latter means is disposed substantially horizontally in use and an outer, vertically oritented wall that is curved congruently to the inner wheel housing against which said breast plate means is positioned during use.

2. The apparatus as set forth in claim 1, further comprising means pivotally coupled to said base means adapted to support the lower end of the shock absorber of said vehicle.

3. The apparatus as set forth in claim 1, wherein said base means comprises a substantially planar support plate positioned rewardly of said axle assembly and having aperture means formed therein for pivotally receiving said breast plate means.

4. The apparatus as set forth in claim 1, wherein said breast plate means includes a plurality of substantially vertically disposed plate means for supporting the base of said hydraulic jack means in a plurality of different bending positions.

5. The apparatus as set forth in claim 1, wherein said breast plate means comprises left and right breast plate assemblies which are substantial mirror images of one another and which are adapted to be used respectively on the left and right front ends of 1948 through 1969 model year Volkswagen automobiles.

6. The apparatus as set forth in claim 5, wherein the rear end of said breast plate means is pivotally attached to the rear of said support plate, and the front end of said breast plate means is movable laterally with respect to the front of said support plate.

7. The apparatus as set forth in claim 6, wherein said clamping means is adjustably connected between said axle assembly and said breast plate means.

8. The apparatus as set forth in claim 7, wherein said clamping means is pivotally attached to the front end of said breast plate means.

9. The apparatus as set forth in claim 8, wherein said clamping means comprises a turnbuckle assembly having a rearwardly extending threaded member pivotally connected to said breast plate means and a forwardly projecting threaded member clampingly secured to said axle assembly at a fulcrum bending point thereon.

10. The apparatus as set forth in claim 3, wherein said base means further comprises an elongated rail assembly positioned transversely with respect to said axle assembly for supporting same at substantially the same height as it would be with the wheel of said vehicle in place.

11. The apparatus as set forth in claim 10, wherein said clamping means comprises means positioned on said rail assembly forwardly of said axle assembly for preventing forward movement thereof.

12. The apparatus as set forth in claim 3, wherein said breast plate means comprises a single breast plate assembly reversibly adaptable for use on both the left and right front ends of Volkswagen automobiles manufactured since 1970.

13. The apparatus as set forth in claim 12, wherein the front end of said single breast plate assembly is pivotally mounted to the forward end of said planar support plate, and the rear end of said single breast plate assembly is laterally movable along the rear portion of said support plate.

14. A method for correcting misalignment of the front end of a vehicle due to a bent front axle assembly without dismantling same, said axle assembly comprising a horizontally disposed twin axle beam and a pair of upper and lower torsion arms extending from each end of said twin axle beam, which comprises the steps of:

clamping said axle beam at a first position; and applying a bending force to said axle assembly at a second position laterally removed from said first position, said second position comprising the outer end of one of said torsion arms;

wherein said force applying step includes the steps of positioning a supporting base underneath said front axle assembly, mounting a jack support member on said base rearwardly of said axle assembly, and operating jack means between said jack support member and said second position; and wherein said clamping step includes the step of positioning abutment means adjacent said axle assembly and connected to said base for preventing forward movement of said axle assembly.

15. The method as set forth in claim 14, wherein said clamping step includes the step of preventing forward and rearward movement of said axle assembly.

16. The method as set forth in claim 15, further comprising the step of positioning said jack means so as to exert substantially lateral pressure on said second position.

17. The method as set forth in claim 15, further comprising the step of positioning said jack means so as to exert substantially upward pressure on said second position.

18. The method as set forth in claim 15, further comprising the step of positioning said jack means so as to exert substantially downward pressure on said second position.

19. Bending apparatus for a vehicle having an inner wheel housing and an axle assembly including a front axle beam and upper and lower torsion arms extending laterally and rearwardly from both ends of said beam, which comprises:

base means adapted to be positioned under said axle beam;

means for bending said axle assembly by applying a force to one of said torsion arms and means for providing a fulcrum for said means for bending; and means mounted on said base means for resting against said inner wheel housing for supporting said bending means during use.

20. The bending apparatus as set forth in claim 19, wherein said means for supporting said bending means comprises a breast plate having a substantially vertically oriented outer wall shaped to fit against said inner wheel housing and plate means extending laterally from said outer wall for receiving said bending means.

21. The bending apparatus as set forth in claim 20, wherein said bending means comprises a hydraulic jack having a base adapted to be positioned adjacent said plate means and an extendable piston adapted to be positioned adjacent one end of said one of said torsion arms.

22. The bending apparatus as set forth in claim 20, wherein said base means comprises a substantially planar support plate having aperture means formed therein, said breast plate pivotally mounted to said support plate via said aperture means.

23. The bending apparatus as set forth in claim 19, further comprising clamping means operatively connected between said axle beam and said means for supporting said bending means.

24. The bending apparatus as set forth in claim 19, wherein said vehicle also includes a shock absorber, and further comprising means connected to said base means for supporting the lower end of said shock absorber.

25. A method for bending an axle assembly of a vehicle having an inner wheel housing, said axle assembly including a front axle beam and upper and lower torsion arms extending laterally and rearwardly from both ends of said beam, which comprises the steps of:

positioning base means under said axle beam;

supporting means for bending said axle assembly by mounting support means on said base means, said support means to receive said bending means and to rest against said inner wheel housing; and bending said axle assembly by applying a force from said bending means to one of said torsion arms and providing a fulcrum to oppose said force.

* * * * *